US009857745B2

(12) United States Patent
Matsue et al.

(10) Patent No.: US 9,857,745 B2
(45) Date of Patent: Jan. 2, 2018

(54) IMAGE FORMING APPARATUS INCORPORATING IMAGE READER

(71) Applicants: Natsumi Matsue, Kanagawa (JP); Akira Yoshida, Tokyo (JP); Akio Kosuge, Kanagawa (JP); Yoichi Sakurai, Kanagawa (JP); Yuuichiroh Uematsu, Kanagawa (JP); Keiko Matsumoto, Kanagawa (JP)

(72) Inventors: Natsumi Matsue, Kanagawa (JP); Akira Yoshida, Tokyo (JP); Akio Kosuge, Kanagawa (JP); Yoichi Sakurai, Kanagawa (JP); Yuuichiroh Uematsu, Kanagawa (JP); Keiko Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/274,366

(22) Filed: Sep. 23, 2016

(65) Prior Publication Data

US 2017/0108808 A1 Apr. 20, 2017

(30) Foreign Application Priority Data

Oct. 14, 2015 (JP) ..... 2015-203034

(51) Int. Cl.
*G03G 15/00* (2006.01)

(52) U.S. Cl.
CPC ..... *G03G 15/5041* (2013.01)

(58) Field of Classification Search
CPC ..... G03G 15/5041; G03G 15/5058; G03G 15/556

(Continued)

(56) References Cited

U.S. PATENT DOCUMENTS 5,953,554 A * 9/1999 Ohnishi ..... G03G 15/0131 399/49
2008/0145089 A1* 6/2008 Takahashi ..... G03G 15/50 399/74

(Continued)

FOREIGN PATENT DOCUMENTS

| | | |
|---|---|---|
| JP | 2006-259278 | 9/2006 |
| JP | 2011-022507 | 2/2011 |
| JP | 2014-021248 | 2/2014 |

OTHER PUBLICATIONS

U.S. Appl. No. 15/436,598, filed Feb. 17, 2017, Yuuichiroh Uematsu, et al.

(Continued)

*Primary Examiner* — Sandra Brase
(74) *Attorney, Agent, or Firm* — Oblon, McClelland, Maier & Neustadt, L.L.P.

(57) ABSTRACT

An image forming apparatus includes a rotatable image bearer, a toner image forming device, an image reader, and a control unit. The toner image forming device forms a test toner image on the image bearer. The image reader reads the test toner image and a predetermined reference member. The control unit calculates an amount of toner contained in the test toner image based on image data from the test toner image. Based on image data from the reference member, the control unit selects a position of a pixel to be used for calculation of the amount of toner contained in the test toner image from pixels included in the image data from the reference member, to calculate the amount of toner contained in the test toner image from data of a pixel located at the position thus selected among pixels included in the image data from the test toner image.

8 Claims, 7 Drawing Sheets

(58) Field of Classification Search
USPC ..... 399/49
See application file for complete search history.

(56) References Cited

U.S. PATENT DOCUMENTS

| | | | |
|---|---|---|---|
| 2013/0004188 | A1 | 1/2013 | Suzuki |
| 2016/0266532 | A1 | 9/2016 | Matsue et al. |

OTHER PUBLICATIONS

U.S. Appl. No. 15/190,685, filed Jun. 23, 2016, Akio Kosuge, et al.

* cited by examiner

IMAGE FORMING APPARATUS INCORPORATING IMAGE READER

CROSS-REFERENCE TO RELATED APPLICATION

This patent application is based on and claims priority pursuant to 35 U.S.C. §119(a) to Japanese Patent Application No. 2015-203034, filed on Oct. 14, 2015, in the Japan Patent Office, the entire disclosure of which is hereby incorporated by reference herein.

BACKGROUND

Technical Field

Embodiments of the present disclosure generally relate to an image forming apparatus, and more particularly, to an image forming apparatus for forming an image on a recording medium, incorporating an image reader.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image carrier. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium carrying the toner image to fix the toner image onto the recording medium. Thus, the image is formed on the recording medium.

Such image forming apparatuses often include an image reader to read a toner image formed on an image bearer. For example, the image reader reads a test toner image formed on an outer circumferential surface of the image bearer so that a controller incorporated in the image forming apparatus calculates an amount of toner contained in the test toner image based on reading of the test toner image by the image reader.

SUMMARY

In one embodiment of the present disclosure, a novel image forming apparatus is described that includes an image bearer, a toner image forming device, an image reader, and a control unit. The image bearer is rotatable in a rotational direction. The Loner image forming device forms a test toner image on an outer circumferential surface of the image bearer. The image reader reads the test toner image on the outer circumferential surface of the image bearer, and reads a predetermined reference member. The control unit calculates an amount of toner contained in the test toner image based on image data from the test toner image. Based on image data from the predetermined reference member, the control unit selects a position of a pixel to be used for calculation of the amount of toner contained in the test toner image from pixels included in the image data from the predetermined reference member, to calculate the amount of toner contained in the test toner image from data of a pixel located at the position thus selected among pixels included in the image data of the test toner image.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
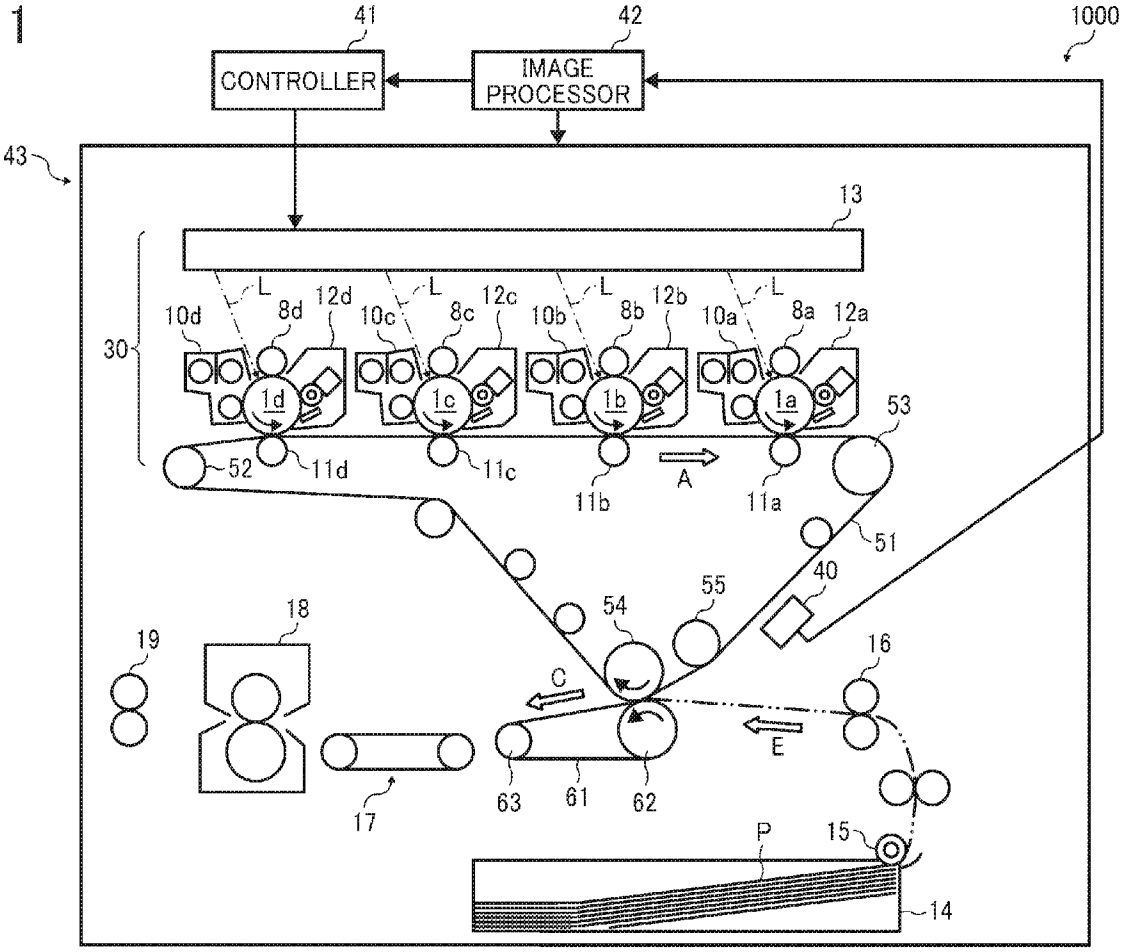
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of the present disclosure are not necessarily indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and K denote colors yellow, magenta, cyan, and black, respectively. To simplify the description, these suffixes are omitted unless necessary.

Referring now to the drawings, embodiments of the present disclosure are described below.

Initially with reference to FIG. 1, a description is given of a basic configuration of an image forming apparatus 1000 according to an embodiment of the present disclosure.

The image forming apparatus 1000 is a color printer that forms color and monochrome toner images on recording media by electrophotography. FIG. 1 is a schematic view of the image forming apparatus 1000. The image forming apparatus 1000 includes, e.g., a control unit or controller 41, an image processor 42, and an image forming device 43.

The controller 41 is constructed of, e.g., a central processing unit (CPU) and a memory, and controls the image forming device 43 to form an image according to one or more control parameters. The control parameters are used as a set of conditions under which the image forming device 43 forms an image. The image processor 42 includes, e.g., an application specific integrated circuit (ASIC) and a memory, and executes various types of image processing on image data input from a client device such as a personal computer, or a scanner.

The image forming device 43 includes, e.g., photoconductors 1*a*, 1*b*, 1*c*, and 1*d* as latent image bearers, chargers 8*a*, 8*b*, 8*c*, and 8*d*, developing devices 10*a*, 10*b*, 10*c*, and 10*d*, cleaning devices 12*a*, 12*b*, 12*c*, and 12*d*, an exposure device 13, an intermediate transfer belt 51, a secondary transfer belt 61, and a fixing device 18.

Different color toner images are formed on the photoconductors 1*a*, 1*b*, 1*c*, and 1*d*. Specifically, toner images of yellow (Y), magenta (M), cyan (C), and black (K) are formed on the photoconductors 1*d*, 1*c*, 1*b*, and 1*a*, respectively. In the present embodiment, the photoconductors 1*d*, 1*c*, 1*b*, and 1*a* are drum-shaped photoconductors. Alternatively, the photoconductors 1*d*, 1*c*, 1*b*, and 1*a* may be endless belt photoconductors entrained around a plurality of rollers and driven to rotate.

The intermediate transfer belt 51 is an endless belt disposed opposite the photoconductors 1*d*, 1*c*, 1*b*, and 1*a*. Each of the photoconductors 1*d*, 1*c*, 1*b*, and 1*a* has an outer circumferential surface contacting an outer circumferential surface of the intermediate transfer belt 51. The intermediate transfer belt 51 as an image bearer is entrained around a plurality of support rollers or support rotary bodies, such as a tension roller 52, a drive roller 53, a repulsive roller 54, and an entry roller 55, thereby forming an endless loop. A driver drives and rotates the drive roller 53, which is one of the support rollers. As the drive roller 53 rotates, the intermediate transfer belt 51 rotates in a rotational direction A.

The intermediate transfer belt 51 may be constructed of a plurality of layers or a single layer. The plurality of layers preferably includes a base layer having an outer circumferential surface coated by a smooth coating layer made of, e.g., fluorine-based resin. The base layer is made of a stretch-resistant fluororesin, polyvinylidene difluoride (PVDF) sheet, polyimide resin or the like. The single layer is preferably made of PVDF, polycarbonate (PC), polyimide or the like.

Inside the loop formed by the intermediate transfer belt 51 are primary transfer rollers 11*d*, 11*c*, 11*b*, and 11*a* disposed opposite the photoconductors 1*d*, 1*c*, 1*b*, and 1*a* via the intermediate transfer belt 51, respectively. As illustrated in FIG. 1, each of the photoconductors 1 is similarly surrounded by various pieces of equipment such as the charger 8, the developing device 10, the primary transfer roller 11, and the cleaning device 12. The photoconductors 1, the chargers 8, the developing devices 10, the primary transfer rollers 11, the exposure device 13 and the like constitute a toner image forming device 30 to form a toner image on the intermediate transfer belt 51. Specifically, in the toner image forming device 30, the toner images of yellow, magenta, cyan, and black are formed on the photoconductors 1*d*, 1*c*, 1*b*, and 1*a*, respectively, and then transferred onto the intermediate transfer belt 51. Thus, the different color toner images are formed on the photoconductors 1, and then transferred onto the intermediate transfer belt 51 identically.

With continued reference to FIG. 1, a detailed description is given of forming a toner image of yellow on the photoconductor 1*d* and primary transferring the toner image of yellow from the photoconductor 1*d* onto the intermediate transfer belt 51, as a representative of the four colors yellow, magenta, cyan, and black.

The photoconductor 1*d* is rotated in a counterclockwise direction in FIG. 1. A discharger emits light to and initializes an outer circumferential surface of the photoconductor 1*d*. The photoconductor 1*d* is further rotated and reaches a position where the photoconductor 1*d* faces the charger 8*d*. The charger 8*d* uniformly charges the initialized outer circumferential surface of the photoconductor 1*d* to a predetermined polarity, in the present embodiment, to a negative polarity. The photoconductor 1*d* is further rotated and reaches a position where the exposure device 13 emits a modulated laser beam L to the charged outer circumferential surface of the photoconductor 1*d*, to form an electrostatic latent image on the outer circumferential surface of the photoconductor 1*d*. Thus, the photoconductor 1*d* bears the electrostatic latent image.

In the image forming apparatus 1000, the exposure device 13 as a laser writer emits the laser beam L. Alternatively, the exposure device 13 may include a light-emitting, diode (LED) array and an imaging device. The photoconductor 1*d* is further rotated and reaches a developing position where the photoconductor 1*d* faces the developing device 10*d*. The developing device 10*d* adheres yellow toner to the electrostatic latent image formed on the outer circumferential surface of the photoconductor 1*d*, thereby developing the electrostatic latent image into a visible toner image of yellow.

The photoconductor 1*d* is further rotated and reaches a position where the photoconductor 1*d* faces, via the intermediate transfer belt 51, the primary transfer roller 11*d* disposed inside the loop formed by the intermediate transfer belt 51. The primary transfer roller 11*d* contacts an inner circumferential surface of the into mediate transfer belt 51 to press against the outer circumferential surface of the photoconductor 1*d*, thereby forming an area of contact, herein called a primary transfer nip, between the outer circumferential surface of the photoconductor 1*d* and the outer circumferential surface of the intermediate transfer belt 51. A primary transfer bias is applied to the primary transfer roller 11*d*. The primary transfer bias has a polarity, in the present embodiment, a positive polarity, opposite a polarity of toner contained in the toner image of yellow formed on the photoconductor 1*d*. Application of the primary transfer bias to the primary transfer roller 11*d* generates a primary-transfer electric field between the photoconductor 1*d* and the intermediate transfer belt 51 to electrostatically transfer the toner image of yellow from the photoconductor 1*d* onto the outer circumferential surface of the intermediate transfer belt 51. The photoconductor 1*d* is further rotated and reaches a position where the photoconductor 1*d* faces the cleaning device 12*d*. The cleaning device 12 removes, from the outer circumferential surface of the photoconductor 1*d*, residual toner failed to be transferred onto the intermediate transfer belt 51 at the primary transfer nip and therefore remaining on the outer circumferential surface of the outer circumferential surface of the photoconductor 1*d*.

In a full-color mode to form toner images of all the four colors, namely, yellow, magenta, cyan, and black, the toner images of magenta, cyan, and black are formed on the respective photoconductors 1*c*, 1*b*, and 1*a*, in the same manner as the toner image of yellow is formed on the photoconductor 1*d* as described above. The toner images of magenta, cyan, and black are superimposed one atop another in sequence on the toner image of yellow, which is transferred onto the intermediate transfer belt 51 at first.

By contrast, in a monochrome mode to form a toner image of black, a contact-separation mechanism separates the primary transfer rollers 11*d*, 11*c*, and 11*b* from the inner circumferential surface of the intermediate transfer belt 51. As a consequence, the intermediate transfer belt 51 separates from the photoconductors 1*d*, 1*c*, and 1*b*. At this time, the intermediate transfer belt 51 is in contact with the photoconductor 1*a*. The toner image of black is formed on the photoconductor 1*a*, and then, primarily transferred onto the intermediate transfer belt 51.

A sheet feeder 14 is disposed at a lower portion of an apparatus body of the image fainting apparatus 1000. The sheet feeder 14 accommodates a plurality of recording media P. A sheet feeding roller 15 rotates to pick up an upper most recording medium P from the sheet feeder 14 and feed the recording medium P in a recording medium conveyance direction E to a registration roller pair 16. The registration roller pair 16 is timed to feed the recording medium P to a secondary transfer nip where the intermediate transfer belt 51 contacts the secondary transfer belt 61 between the repulsive roller 54 and a secondary transfer roller 62 facing the repulsive roller 54 via the intermediate transfer belt 51 and the secondary transfer belt 61. At this time, a secondary transfer power supply as a transfer voltage output device applies a secondary transfer bias to the repulsive roller 54, to secondarily transfer the toner image from the intermediate transfer belt 51 onto the recording medium P.

As illustrated in FIG. 1, the secondary transfer belt 61 is an endless belt entrained around the secondary transfer roller 62 and a separation roller 61. One of the secondary transfer roller 62 and the separation roller 63 is rotated as a drive roller to rotate the secondary transfer belt 61 in a rotational direction C. As the recording medium P is attracted to an outer circumferential surface of the secondary transfer belt 61 by static electricity, the rotation of the secondary transfer belt 61 conveys the recording, medium P bearing the toner image from the secondary transfer nip. Then, the curvature of the secondary transfer belt 61 at a portion in contact with the separation roller 63 causes the recording medium P to separate from the outer circumferential surface of the secondary transfer belt 61. The recording medium P is further conveyed downstream in the recording medium conveyance direction E to the fixing device 18 by a conveyor belt 17 disposed downstream from the secondary transfer belt 61 in the recording medium conveyance direction E. In the fixing device 18, the toner image is fixed onto the recording medium P by heat and pressure. The recording medium P bearing the fixed toner image is then conveyed to a sheet ejection roller pair 19. The sheet ejection roller pair 19 ejects the recording medium P outside the apparatus body of the image forming apparatus 1000.

In the present embodiment, the image forming apparatus 1000 includes, e.g., an image sensor 40, a density corrector, and a reading controller to correct the density or unevenness in density of an image. The controller 41 serves as the density corrector and the reading controller. For example, the density corrector and the reading controller are implemented as the CPU executing a single program or a plurality of programs stored in the memory.

In the present embodiment, the test toner image forming device 30 forms a test toner image on the intermediate transfer belt 51 and the image sensor 40 optically reads the test toner image. Therefore, the image sensor 40 is disposed downstream from the extreme downstream primary transfer roller 11*a* in the rotational direction A of the intermediate transfer belt 51. On the other hand, the image sensor 40 is disposed upstream from the repulsive roller 54, disposed opposite the secondary transfer roller 62, in the rotational direction A of the intermediate transfer belt 51.

The image sensor 40 is not limited to reading only a test toner image formed on the intermediate transfer belt 51. Alternatively, a test toner image may be formed on the recording medium P and the image sensor 40 may be configured to read the test toner image on the recording medium P.

Referring now to FIGS. 2 through 5, a detailed description is given of the image sensor 40.

Figure 2:
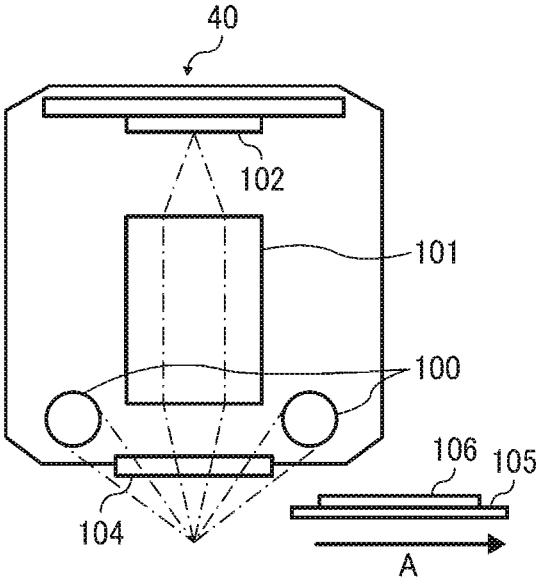
FIG. 2 is a schematic view of an image sensor incorporated in the image forming apparatus of FIG. 1.

Initially with reference to FIG. 2, a description is given of a configuration of the image sensor 40.

FIG. 2 is a schematic view of the image sensor 40. The image sensor 40 includes, inside a sensor body, e.g., light sources 100, a lens array 101, an image line sensor 102, a detection window 104 made of transparent glass, a shutter 105, and a white reference board 106.

An actuator drives the shutter 105 to move back and forth along the rotational direction A of the intermediate transfer belt 51. By moving back and forth, the shutter 105 opens and closes the detection window 104. In FIG. 2, the shutter 105 is moved from beneath the detection window 104, thereby opening the detection window 104.

The white reference board 106 may be, e.g., a LUMIRROR® E20 (produced by Toray Industries, Inc), which is a white film. The white reference board 106 is secured to a back surface of the shutter 105 by, e.g., double-sided adhesive tape, thereby moving back and forth together with the shutter 105 along the rotational direction A of the intermediate transfer belt 51.

Each of the light sources 100 may be constructed of a light guide having an end provided with a light emitting device. Alternatively, LED arrays may be used as the light sources 100. In the present embodiment, the light sources 100 emit white light. Alternatively, however, light sources that individually emit red light, green light, and blue light may be disposed.

The lens array 101 includes, e.g., a SELFOC® lens. The image line sensor 102 is an image sensor array constructed of a plurality of image sensors. The image sensors individually receive red light, green light, and blue right focused by the lens array 101 and output signals corresponding to the red light, the green light, and the blue light. The image line sensor 102 may be, e.g., a complementary metal oxide semiconductor (CMOS) sensor or a charge-coupled device (CCD) sensor.

The image sensor 40 may be, e.g., a contact image sensor (CIS).

Figure 3:
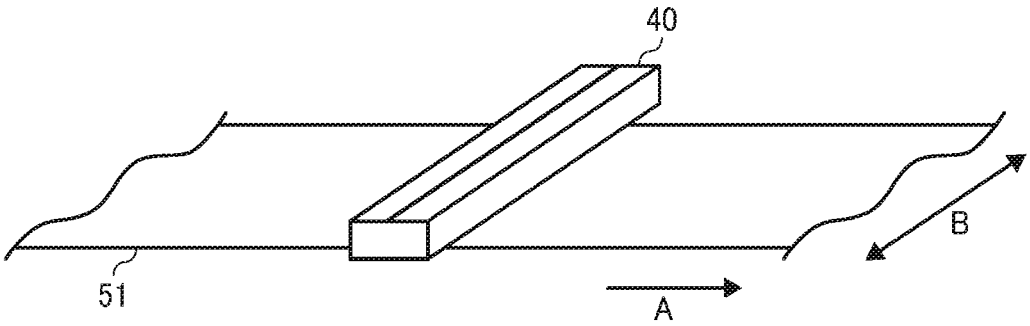
FIG. 3 is a perspective view of the image sensor together with a part of an intermediate transfer belt incorporated in the image forming apparatus of FIG. 1.

FIG. 3 is a perspective view of the image sensor 40 together with a part of the intermediate transfer belt 51. As illustrated in FIG. 3, the image sensor 40 is longer than the width of the intermediate transfer belt 51 in a direction indicated by arrow B (hereinafter referred to as width direction B). Accordingly, the image sensor 40 reads an entire area of the test toner image on the intermediate transfer belt 51. It is to be noted that, even if the image sensor 40 is not longer than the width of the intermediate transfer belt 51, the image sensor 40 reads the entire area of the test toner image on the intermediate transfer belt 51 provided that the image sensor 40 is equal to or longer than a length of an effective image area in the width direction B of the intermediate transfer belt 51.

As described above. FIG. 2 illustrates the image sensor 40 in which the detection window 104 is opened by the shutter 105 that is moved from beneath the detection window 104.

Figure 4:
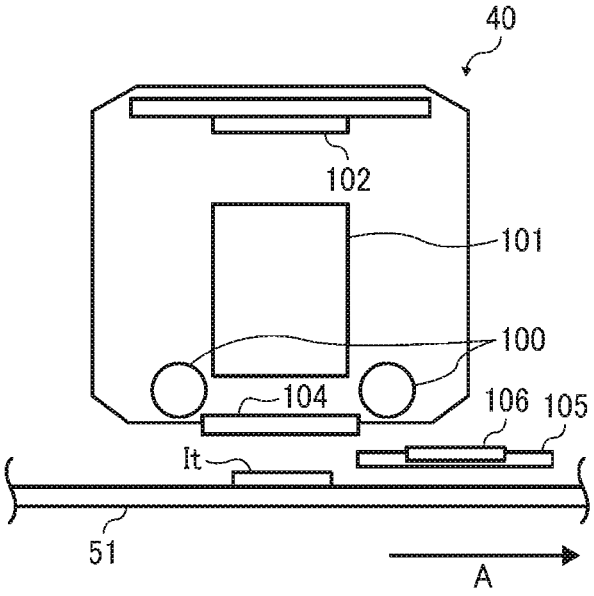
FIG. 4 is a schematic view of the image sensor with a detection window opened by a shutter.
Figure 5:
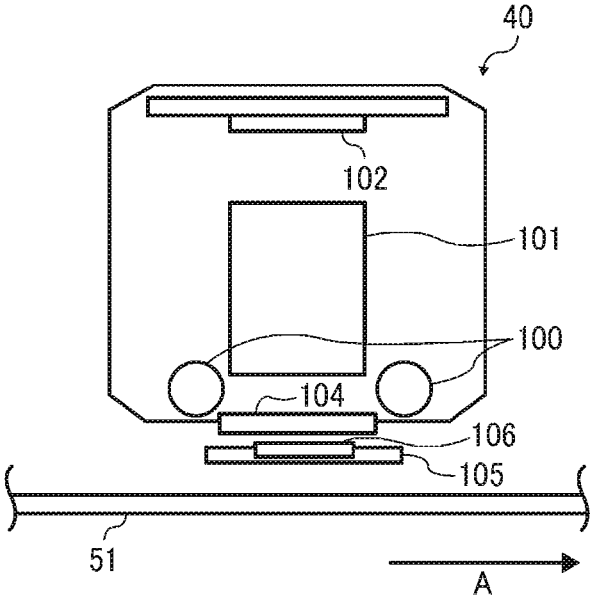
FIG. 5 is a schematic view of the image density sensor with the detection window closed by the shutter.

FIG. 4 is a schematic view of the image sensor 40 with the detection window 104 opened by the shutter 105. FIG. 5 is a schematic view of the image sensor 40 with the detection window 104 closed by the shutter 105.

The image sensor 40 reads a test toner image It formed on the intermediate transfer belt 51 through the detection window 104 that is opened as illustrated in FIG. 4. By contrast, as illustrated in FIG. 5, the shutter 105 is moved to beneath the detection window 104, thereby closing the detection window 104 under control of the controller 41 when the image sensor 40 does not read, e.g., the test toner image It. Such a configuration prevents contamination of the detection window 104. When the shutter 105 closes the detection window 104, the image sensor 40 does not read the test toner image It on the intermediate transfer belt 51, but instead reads the white reference board 106 secured to the back surface of the shutter 105.

The controller 41 is timed to perform a parameter correction process to correct one or more control parameters. In the parameter correction process, test toner images of yellow, magenta, cyan, and black are individually formed on the intermediate transfer belt 51 and the image sensor 40 reads the test toner images of yellow, magenta, cyan, and black. For example, an amount of toner contained in the test toner image of yellow is calculated based on reading of the test toner image of yellow by the image sensor 40. Based on the calculation, one or more predetermined control parameters are corrected that have an impact on the image density of the test toner image of yellow, thereby obtaining a predetermined density of the test toner image of yellow. Similarly, for each color of magenta, cyan, and black, one or more predetermined control parameters are corrected that have an impact on the image density of the test toner image, based on calculation of the amount of toner contained in the test toner image, thereby obtaining a predetermined density of the test toner image.

At initial operation after factory shipment, the controller 41 performs a shading correction data construction process. In the shading correction data construction process, shading correction data is constructed based on pixel data included in image data of the white reference board 106 read by the image sensor 40. Specifically, if the white reference board 106 and the detection window 104 are perfectly clean, each pixel of the image data of the white reference board 106 is white theoretically. For example, tones of red (R), green (G), and blue (B) of each pixel are expressed in natural number of eight bits with 201 tones from 0 to 200, handling tones from 200 to 255, out of the tones from 0 to 255, as a tone 200. In this case, if the white reference board 106 and the detection window 104 are perfectly clean, each pixel of the image data of the white reference board 106 has a value (R=200, G=200, B=200). However, in actuality, the pixels of the image data may slightly differ in value due to variation in sensitivity of imaging elements of an image line sensor or variation in amount of light emitted from light sources. Therefore, unevenness in density might be erroneously detected. In order to prevent such erroneous detection of unevenness in density, correction data for identifying all the pixels as white is constructed as the shading correction data. Typically, image forming apparatuses often form a test toner image of black on an image bearer such as an intermediate transfer belt and calculate an amount of toner contained in the test toner image of black based on reading of the test toner image by an image reader such as a line sensor. Before the amount of toner is calculated, light that is less affected by contamination of the image reader by toner than other light is identified among red light, green light, and blue light detectable by the image reader. Specifically, the image reader reads a predetermined reference board and indicates received light amounts of red, green, and blue. Based on differences between the received light amounts of red, green, and blue and predetermined reference light amounts of red, green, and blue, the light that is less affected by the toner contamination than other light is identified among the red light, green light, and blue light. Then, the image reader reads the test toner image of black and indicates received light amounts of red, green, and blue. The amount of toner contained in the test toner image of black is calculated by using the received light amount of indicated when the image reader reads the test toner image of black, corresponding to the light thus identified. Even when color toner such as cyan or magenta toner contaminates the image reader, the amount of toner contained in the test toner image of black may be accurately obtained.

However, when black toner contaminates the image reader, such contamination by black toner affects all the received light amounts of red, green, and blue detectable by the image reader. In such a case, the amount of toner contained in the test toner image of black may not be accurately obtained.

According to an embodiment of the present disclosure, the amount of toner contained in the test toner image is calculated more accurately, regardless of the color of toner that contaminates the image reader and the color of the test toner image.

Figure 6:
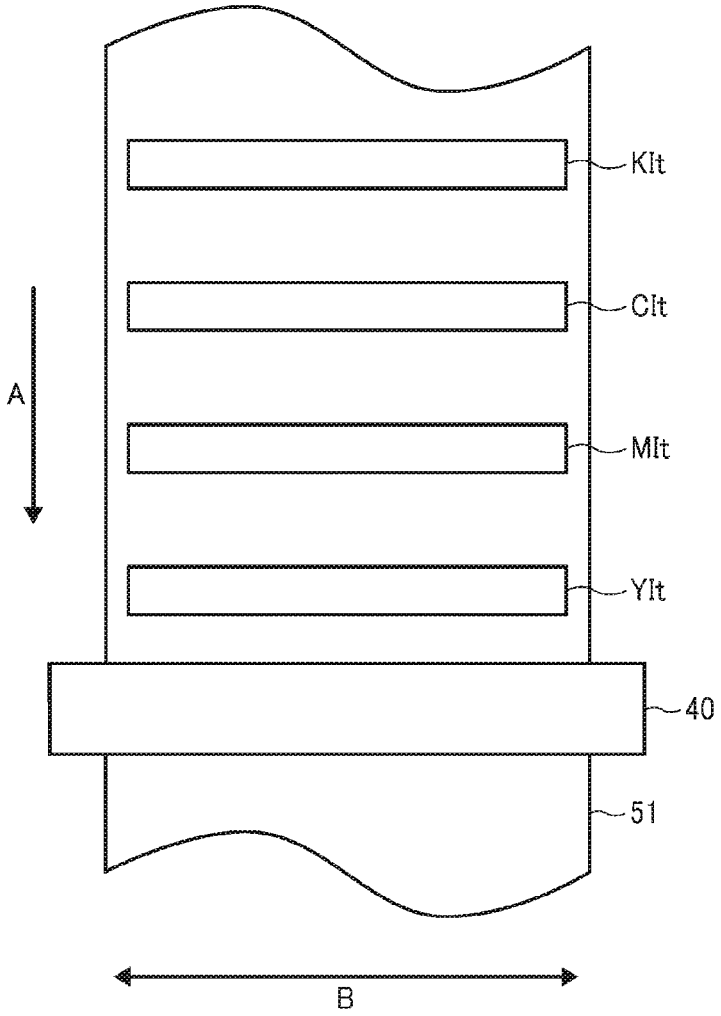
FIG. 6 is a plan view of test toner images formed on the intermediate transfer belt in a parameter correction process executed by a controller incorporated in the image forming apparatus of FIG. 1, together with the image sensor.

FIG. 6 is a plan view of the test toner images formed on the intermediate transfer belt 51 in the parameter correction process, together with the image sensor 40. In the parameter correction process, test toner images YIt, MIt, CIt, and KIt of yellow, magenta, cyan, and black, respectively, are arrayed at intervals in the rotational direction A of the intermediate transfer belt 51. Each of the test toner images YIt, MIt, CIt, and KIt is elongated in the width direction B of the intermediate transfer belt 51. The image sensor 40 reads the test toner images YIt, MIt, CIt, and KIt in sequence.

Figure 7:
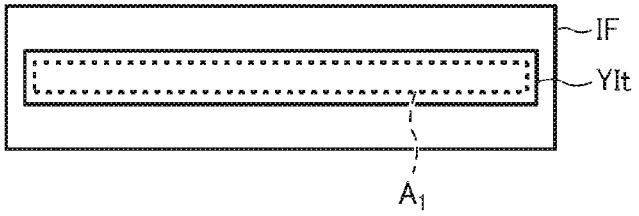
FIG. 7 is a schematic view of an image reproduced according to image data of a test toner image of yellow read by the image sensor.

FIG. 7 is a schematic view of an image reproduced according to image data of the test toner image YIt read by the image sensor 40. To form the test toner image YIt on the intermediate transfer belt 51 as illustrated in FIG. 6, the exposure device 13 emits the laser beam L to the photoconductor 1*a*, or scans the photoconductor 1*a*, to form an electrostatic latent image on the photoconductor 1*a*. The developing device 10*a* develops the electrostatic latent image into a visible test toner image of yellow. The test toner image is transferred onto the intermediate transfer belt 51, as the test toner image YIt. As the intermediate transfer belt 51 rotates, the test toner image YIt is conveyed to a position where the test toner image YIt faces the image sensor 40. Thus, it takes a predetermined time from when the exposure device 13 starts scanning the photoconductor 1*a* until when the test toner image YIt reaches the position where the test toner image YIt faces the image sensor 40. Slightly before the predetermined time elapses since the exposure device 13 starts scanning the photoconductor 1*a*, the image sensor 40 starts reading the test toner image YIt. When the predetermined time elapses, the image sensor 40 stops reading.

FIG. 7 illustrates an image reproduced according to image data obtained from the reading described above. As illustrated in FIG. 7, the test toner image YIt is reproduced in an image frame IF having a predetermined size. Although the position of the test toner image YIt may slightly vary in the image frame IF due to speed errors of the intermediate transfer belt 51 and the photoconductor 1*a*, the test toner image YIt stays in the image frame IF even if the intermediate transfer belt 51 and the photoconductor 1*a* causes maximum speed errors.

In the present embodiment, a density detection area $A_1$ is predetermined for image data. As illustrated in FIG. 7, the density detection area $A_1$ is a rectangle smaller than the test toner image YIt. The density detection area $A_1$ is a predetermined pixel area in a pixel matrix of the image frame IF. The size and the position of the density detection area $A_1$ are determined such that the entire density detection area $A_1$ includes the test toner image YIt, even if the position of the test toner image YIt slightly varies in the image frame IF.

When the controller 41 starts the parameter correction process, the image sensor 40 reads the white reference board 106 secured to the back surface of the shutter 105. The shutter 105 is positioned beneath the detection window 104, thereby closing the detection window 104. Thereafter, the image sensor 40 reads the test toner images YIt, MIt, CIt, and KIt. Among all pixels included in image data of the white reference board 106 read by the image sensor 40, a pixel value of each pixel existing within the density detection area $A_1$ (hereinafter referred to as detected pixel) is stored. The pixel value expresses the darkness or brightness of each of, e.g., red, green, and blue in 201 tones. The controller 41 compares the pixel value thus stored to standard data predetermined, for each detected pixel. The standard data is, e.g., data (R=200, G=200, B=200) indicating white. All the detected pixels have identical pixel value data when the detection window 104 and the white reference board 106 are clean.

The controller 41 obtains the difference between the detected pixel and the standard data for each color of red, green, and blue. The controller 41 then determines that a detected pixel exceeding a standard deviation as a predetermined threshold deviation for red, green, or blue is unusable for calculation of an amount of toner contained in the test toner image. By contrast, the controller 41 selects a detected pixel not exceeding the standard deviation for all the colors of red, green, and blue as a detected pixel that is usable for calculation of the amount of toner contained in the test toner image. The detected pixel thus selected for calculation of the amount of toner contained in the test toner image is hereinafter referred to as selected pixel.

Thereafter, the controller 41 obtains image data of the test toner image YIt and calculates an amount of toner contained in the test toner image YIt based on a pixel value of each pixel located at a position identical to a position at which the selected pixel is located (hereinafter referred to as pixel at selected position), among detected pixels included in the image data of the test toner image YIt. Then, the controller 41 calculates an amount of toner contained in each pixel at selected position, and averages the amounts of toner thus calculated. The average amount of toner is defined as an amount of toner contained in the test toner image YIt per unit area. Similarly, an amount of toner contained in each of the test toner images MIt, CIt, and KIt per unit area is calculated.

Based on the amount of toner thus calculated for each color of yellow, magenta, cyan, and black, the controller 41 corrects one or more predetermined control parameters to obtain a desired image density.

Figure 8:
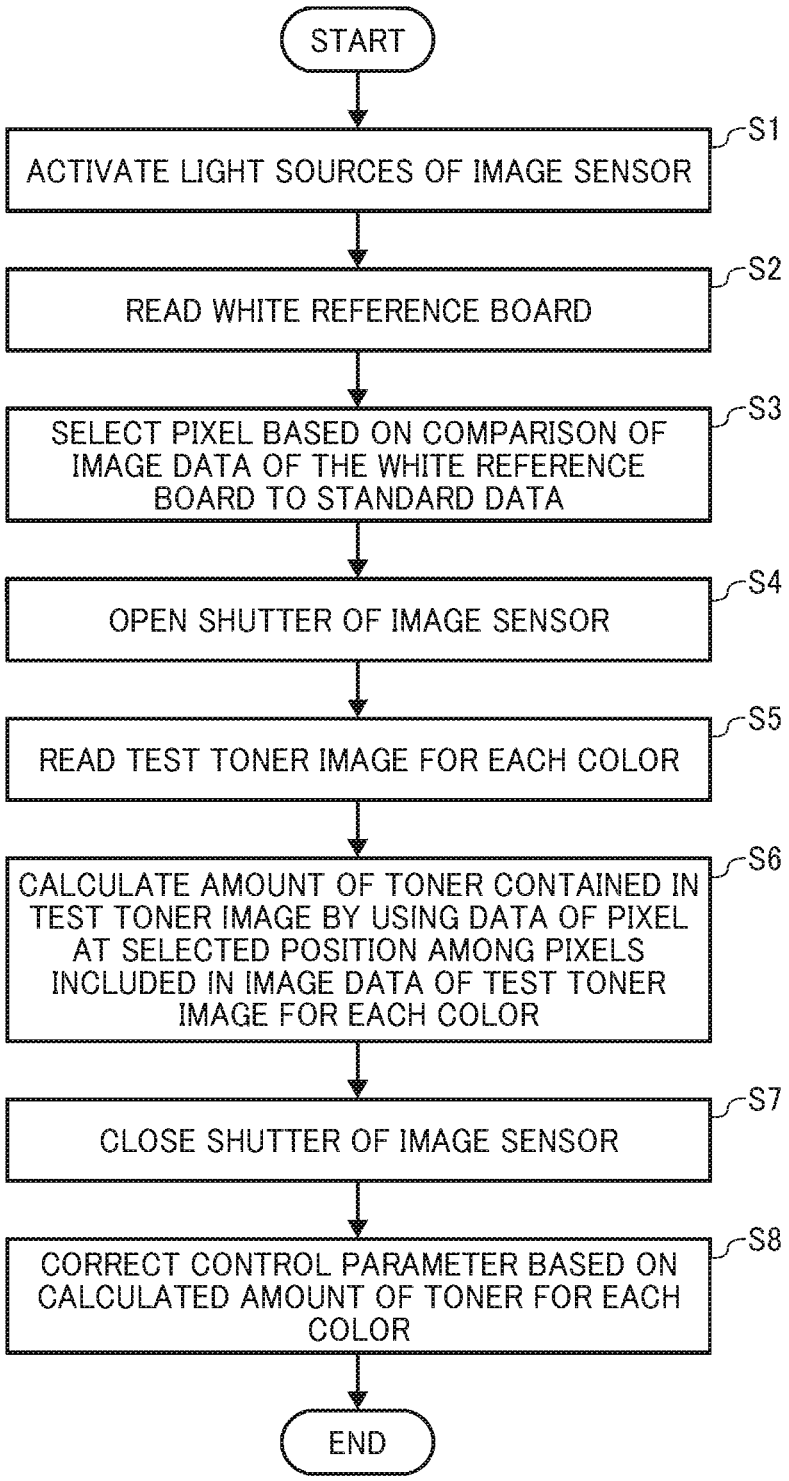
FIG. 8 is a flowchart of the parameter correction process executed by the controller.

FIG. 8 is a flowchart of the parameter correction process executed by the controller 41. The controller 41 starts the parameter correction process with activation of the light sources 100 in step 1 (S1). Then, the controller 41 reads the white reference board 106 with the image sensor 40 in step 2 (S2). Based on comparison of a pixel value of each pixel within the density detection area $A_1$ in image data of the white reference board 106 read by the image sensor 40 to the standard data, the controller 41 selects pixels not affected by toner contamination from the pixels within the density detection area $A_1$ in step 3 (S3). Then, the controller 41 open the shutter 105 in step 4 (S4). That is, the controller 41 moves the shutter 105 to open the detection window 104. Thereafter, the controller 41 reads in sequence the test toner images YIt, MIt, CIt, and KIt transferred onto the intermediate transfer belt 51, with the image sensor 40 in step 5 (S5). In step 6 (S6), for each color of yellow, magenta, cyan, and black, the controller 41 calculates an amount of toner contained in the test toner image by using data of pixels at selected position among pixels within the density detection area $A_1$ in image data of the test toner image read by the image sensor 40. Thereafter, the controller 41 closes the shutter 105 in step 7 (57). That is, the controller 41 moves the shutter 105 to close the detection window 104. Finally, in step 8 (S8), the controller 41 corrects one or more control parameters based on the amount of toner thus calculated for each color of yellow, magenta, cyan, and black.

In the present embodiment, the controller 41 determines that, among all the detected pixels, the pixels not affected by the toner contamination of the detection window 104 and the white reference board 106 are usable for the calculation of the amount of toner contained in the test toner image. The controller 41 then calculates the amount of toner contained in the test toner image by using the data of the pixels predetermined as not being affected by the toner contamination among all the pixels included in the image data of the test toner image. Accordingly, the amount of toner contained in the test toner image is more accurately calculated, regardless of the color of toner that contaminates the detection window 104 and the white reference board 106 and the color of the test toner image.

If the number of unselected pixels affected by the toner contamination among the pixels within the density detection area $A_1$ is equal to or over a predetermined threshold, the controller 41 executes a display process that the controller 41 displays a message on a control panel of the image forming apparatus 1000 to prompt cleaning of the detection window 104 and the white reference board 106. For example, the message may be "Please clean the image sensor in accordance with the procedure on page 18 of the instruction manual." Alternatively, the message may be "Error No. 002 has occurred. Please call the service center for repair."

Figure 9:
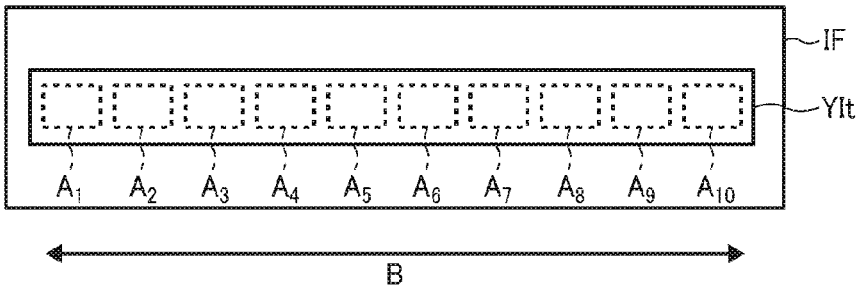
FIG. 9 is a schematic view of an image reproduced according to the image data of the test toner image of yellow obtained in the image forming apparatus according to a first example of the embodiment of the present disclosure.

Referring now to FIG. 9, a description is given of a first example of the embodiment described above.

FIG. 9 is a schematic view of an image reproduced according to the image data of the test toner image YIt obtained in the image forming apparatus 1000 according to the first example of the embodiment described above.

The controller 41 calculates an amount of toner contained in each of ten areas arrayed within the test toner image YIt in the width direction B of the intermediate transfer belt 51. Specifically, as illustrated in FIG. 9, ten density detection areas $A_1$ through $A_{10}$ are predetermined for image data indicated by the image sensor 40. As the image sensor 40 reads the white reference board 106, the controller 41 selects pixels based on comparison of the pixels to the standard data for each of the density detection areas $A_1$ through $A_{10}$ in the image data of the white reference board 106 read by the image sensor 40. Then, the image sensor 40 reads the test toner image YIt. The controller 41 calculates an amount of toner contained in each pixel at selected positions within each of the density detection areas $A_1$ through $A_{10}$ in image data of the test toner image YIt read by the image sensor 40. Then, the controller 41 averages the amounts of toner thus calculated. The average amount of toner is defined as an amount of toner contained in the test toner image YIt per unit area. Similarly, for each of the test toner images MIt, CIt, and KIt, the controller 41 calculates an amount of toner contained in each of the density detection areas $A_1$ through $A_{10}$.

For each color of yellow, magenta, cyan, and black, the image density may be uneven with gradation due to inclination of, e.g., a photoconductor, a developing device, or a charger. Specifically, the image density of a toner image formed on an intermediate transfer belt may gradually increase or decrease from one end to the other of the toner image in a width direction of the intermediate transfer belt. In the parameter correction process, the controller 41 determines whether the image density is uneven with gradation, based on the amount of toner in the density detection areas $A_1$ through $A_{10}$, for each color of yellow, magenta, cyan, and black. If the image density is uneven with gradation, the controller 41 fine-tunes the intensity of the laser beam L directed onto the photoconductor 1 in a main scanning direction, that is, the width direction B of the intermediate transfer belt 51, based on the gradation of the image density. Thus, the controller 41 constructs beam fine-tuning data to equalize the image density in the width direction B of the intermediate transfer belt 51 and prevent such uneven density with gradation. When forming or writing an electrostatic latent image on the photoconductor 1, the controller 41 fine-tunes the intensity of the laser beam L as a control parameter in the main scanning direction, based on the beam fine-tuning data.

Thus, in the present example, the parameter correction process prevents such uneven density with gradation to obtain an image with even density in the width direction B of the intermediate transfer belt 51.

Figure 10:
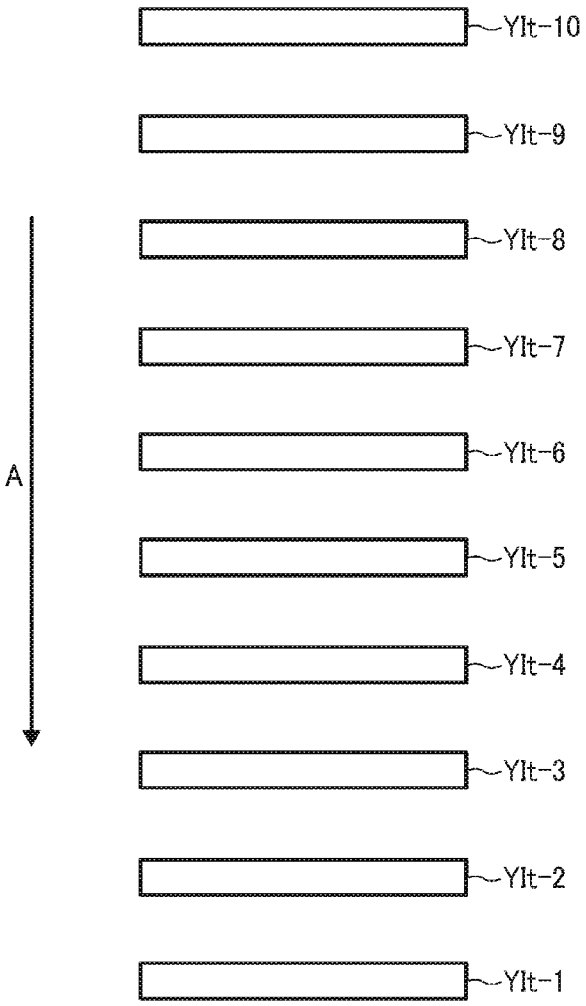
FIG. 10 is a plan view of a test pattern image of yellow formed in the parameter correction process executed in the image forming apparatus according to a second example of the embodiment of the present disclosure.

Referring now to FIG. 10, a description is given of a second example of the embodiment described above. In the developing device 10, an electrified amount Q/M of toner changes over time. The change of the electrified amount Q/M changes developability, and further changes the image density when various parameters are fixed. Hence, in the present example, the parameter correction process is executed to keep the image density stable for a long period of time.

FIG. 10 is a plan view of a test pattern image of yellow formed in the parameter correction process executed in the image forming apparatus 1000 according to the second example of the embodiment described above. The test pattern image of yellow is constructed of ten test toner images of yellow, namely, test toner images YIt-1 through YIt-10, arrayed in the rotational direction A of the intermediate transfer belt 51. Each of the test toner images YIt-1 through YIt-10 is developed with a developing potential, which is a potential difference between a developing bias and an electrostatic latent image, different from each other. The amount of toner gradually increases from the test toner image YIt-1 to the test toner image YIt-10.

In the parameter correction process, the controller 41 is capable of calculating an amount of toner contained in each of ten density detection areas $A_1$ through $A_{10}$ within each of the test toner images YIt-1 through YIt-10, similarly to the first example described above. However, in the present example, the controller 41 calculates an amount of toner contained in a density detection area including the smallest number of unselected pixels affected by toner contamination among the density detection areas $A_1$ through $A_{10}$. The amount of toner thus calculated is defined as a total amount of toner contained in the test toner image of yellow. Accordingly, accurate detection of the amount of toner is enhanced even if the selected pixels are relatively few.

After calculating an amount of toner contained in each of the test toner images YIt-1 through YIt-10, the controller 41 obtains a developing gamma (γ) based on ten developing potentials with which the test toner images YIt-1 through YIt-10 are developed and the ten amounts of toner calculated as described above. Specifically, the controller 41 obtains a linear approximation formula that indicates a relationship between the amount of toner and the developing potential as a control parameter by a least-squares approach, thereby obtaining the developing gamma as a gradient of the linear approximation formula. Then, the controller 41 identifies a developing potential with which a target amount of toner is obtained, based on the developing gamma thus obtained and the target amount of toner. Thereafter, the controller 41 sets a developing potential of yellow for a print job at the developing potential thus identified.

Similarly, for each color of magenta, cyan, and black, a developing gamma is obtained based on calculation of amounts of toner contained in the test toner images to correct the developing potential.

Figure 11:
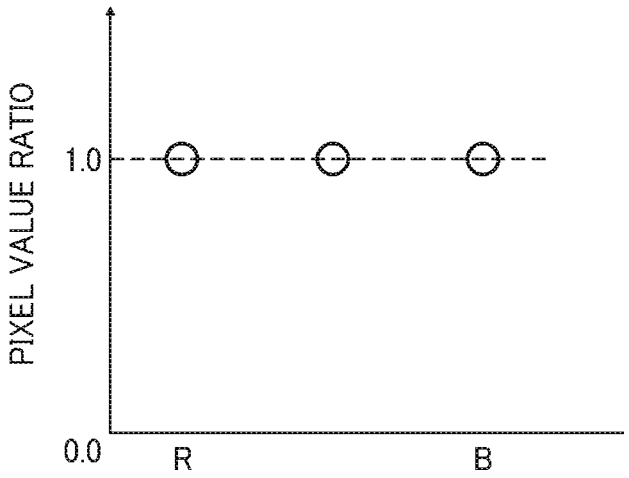
FIG. 11 is a graph of a pixel value ratio of a pixel included in image data of a white reference board read by the image sensor through the detection window not contaminated by toner.
Figure 12:
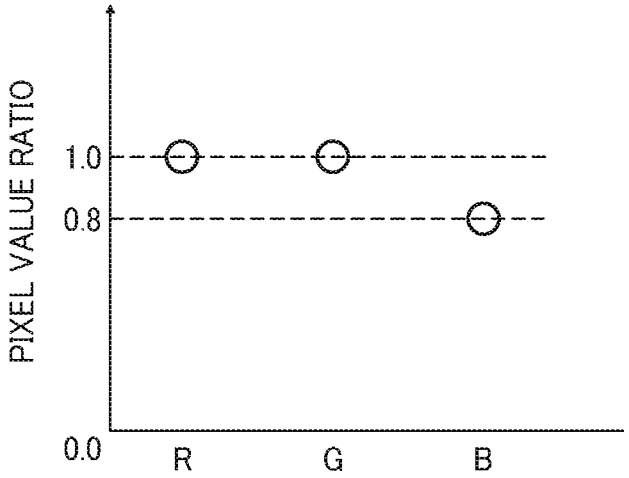
FIG. 12 is a graph of a pixel value ratio of an unselected pixel included in image data of the white reference board read by the image sensor through the detection window contaminated by yellow toner.

Referring now to FIGS. 11 and 12, a description is given of a third example of the embodiment described above.

FIG. 11 is a graph of a pixel value ratio of a pixel included in image data of the white reference board 106 read by the image sensor 40 through the detection window 104 not contaminated by toner. When the detection window 104 is not contaminated by toner, each pixel has a pixel value (R=200, G=200, B=200). That is, the ratio (R:G:B) in the pixel value is 1:1:1, as illustrated in FIG. 11.

FIG. 12 is a graph of a pixel value ratio of an unselected pixel included in image data of the white reference board 106 read by the image sensor 40 through the detection window 104 contaminated by yellow toner. In the image data, pixel values of unselected pixels are affected by contamination by yellow toner. Specifically, a received light amount of each of red and green as components of yellow, is greater than a received light amount of blue, which is not a component of yellow. As illustrated in FIG. 12, the ratio (B:R:G) is 0.8:1:1. Similarly, for each color of magenta, cyan, and black, a particular color light is smaller than the other color light in proportion of a pixel value, depending on the color of toner. Thus, based on the proportion in a pixel value, the color of toner as a contaminant is identified.

Even if a pixel is affected by toner contamination, the pixel value may less affected by the toner contamination with respect to colors different from a color of toner as a contaminant. Accordingly, the controller 41 selects pixels for each color of yellow, magenta, cyan, and black, based on image data of the white reference board 106 read by the image sensor 40. Specifically, as described above, the controller 41 selects pixels from pixels within the density detection area $A_1$ based on the image data. Next, the controller 41 identifies the color of toner as a contaminant based on the proportion in a pixel value of each unselected pixel. The controller 41 finally selects, as the selected pixels described above, the pixels of colors other than the color thus identified, among the colors yellow, magenta, cyan and black. In short, even if the pixel is affected by toner contamination, the pixel is selected with respect to a color different from a color of toner as a contaminant.

Although specific embodiments and examples are described, the embodiments and examples according to the present disclosure are not limited to those specifically described herein. Several aspects of the image forming apparatus are exemplified as follows.

Aspect 1.

An image forming apparatus (e.g., image forming apparatus 1000) includes an image bearer (e.g., intermediate transfer belt 51) rotatable in a rotational direction (e.g., rotational direction A), a toner image forming device (e.g., toner image forming device 30) to form a test toner image on an outer circumferential surface of the image bearer, an image reader (e.g., image sensor 40) to read the test toner image on the outer circumferential surface of the image bearer, and a control unit (e.g., controller 41) to calculate an amount of toner contained in the test toner image based on image data from the test toner image. The image reader reads a predetermined reference member (e.g., white reference board 106). Based on image data from the predetermined reference member, the control unit selects a position of a pixel to be used for calculation of the amount of toner contained in the test toner image from pixels included in the image data from the predetermined reference member. The control unit then calculates the amount of toner contained in the test toner image from data of a pixel located at the position thus selected among pixels included in the image data from the test toner image.

In such a configuration, the control unit selects a pixel not affected by contamination of the image reader by toner from the pixels included in the image data of the predetermined reference member read by the image reader, as a pixel to be used for calculation of the amount of toner contained in the test toner image. Then, the control unit calculates the amount of toner contained in the test toner image by using the data of the pixel located at the selected position among the pixels included in the image data of the test toner image read by the image reader. Accordingly, the amount of toner contained in the test toner image is calculated more accurately, regardless of the color of toner that contaminates the image reader and the color of the test toner image.

Aspect 2.

In the image forming apparatus according to Aspect 1, the control unit selects the position based on a comparison of the image data from the predetermined reference member to predetermined data. The control unit uses the data of the pixel located at the position selected, among the pixels included in the image data from the test toner image, to calculate the amount of toner contained in the test toner image. In such a configuration, the control unit identifies a pixel that is not affected by toner contamination based on the comparison of the image data of the predetermined reference member read by the image reader to the predetermined data.

Aspect 3.

In the image forming apparatus according to Aspect 2, the control unit compares red, green, and blue values of each pixel included in the image data from the predetermined reference member to respective red, green, and blue values of the predetermined data, to determine if each pixel included in the image data from the predetermined reference member is usable for calculation of the amount of toner contained in the test toner image. In such a configuration, for each pixel of the image data of the predetermined reference member, the control unit determines more accurately if the pixel is affected by the toner contamination based on the comparison of the red, green, and blue values of each pixel of the image data of the predetermined reference member and the respective red, green, and blue values of the predetermined data.

Aspect 4.

In the image forming apparatus according to Aspect 3, the test toner image includes a plurality of areas in a direction (e.g., width direction B) perpendicular to the rotational direction of the image bearer. The control unit calculates an amount of toner contained in each of the plurality of areas of the test toner image. In such a configuration, for each of the plurality of areas of the test toner image, the control unit calculates more accurately without being affected by the contamination of the image reader by toner.

Aspect 5.

In the image forming apparatus according to Aspect 4, the control unit corrects one or more control parameters to equalize image density in the direction perpendicular to the rotational direction of the image bearer, based on the amount of toner contained in each of the plurality of areas of the test toner image thus calculated. Such a configuration enhances prevention of image unevenness that may be caused by, e.g., inclination of a developing device incorporated in the image forming apparatus.

Aspect 6.

In the image forming apparatus according to any one of Aspects 3 through 5, the toner image forming device forms test toner images of yellow, magenta, cyan, and black. The control unit determines if the pixel included in the image data from the predetermined reference member is usable for calculation of an amount of toner contained in each of the test toner images of yellow, magenta, cyan, and black. In such a configuration, by using data of a pixel that is affected by contamination by toner of one of yellow, magenta, cyan, and black, but not affected by contamination by toner of the other three colors of yellow, magenta, cyan, and black, the control unit calculates the amounts of toner contained in the test toner images of the other three colors.

Aspect 7.

In the image forming apparatus according to any one of Aspects 3 through 6, when at least one of differences between the red, blue, and green values of the pixel and the respective red, blue, and green values of the predetermined data exceeds a predetermined threshold deviation, the control unit determines the pixel is unusable for calculation of the amount of toner contained in the test toner image. In such a configuration, the control unit determines more accurately that the pixel affected by the toner contamination is unusable for calculation of the amount of toner contained in the test toner image.

Aspect 8.

In the image forming apparatus according to any one of Aspects 2 through 7, the control unit displays a message to prompt cleaning of the image reader or the predetermined reference member based on the number of pixels that the control unit determines are unusable for calculation of the amount of toner contained in the test toner image. In such a configuration, the control unit prompts solving the toner contamination, when the contamination hampers an accurate calculation of the amount of toner, thereby enhancing accuracy in calculation.

The present disclosure has been described above with reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings. Any one of the above-described operations may be performed in various other ways, for example, in an order different from the one described above.

What is claimed is:

1. An image forming apparatus comprising:

an image bearer rotatable in a rotational direction;

a toner image forming device to form a test toner image on an outer circumferential surface of the image bearer;

an image reader to read the test toner image on the outer circumferential surface of the image bearer, the image reader to read a predetermined reference member; and a control unit, implemented by circuitry, to calculate an amount of toner contained in the test toner image based on image data from the test toner image, wherein, based on image data from the predetermined reference member, the control unit selects a position of a pixel to be used for calculation of the amount of toner contained in the test toner image from pixels included in the image data from the predetermined reference member, to calculate the amount of toner contained in the test toner image from data of a pixel located at the position thus selected among pixels included in the image data from the test toner image.

2. The image forming apparatus according to claim 1, wherein the control unit selects the position of the pixel based on a comparison of the image data from the predetermined reference member to predetermined data, and wherein the control unit uses the data of the pixel located at the position selected to calculate the amount of toner contained in the test toner image.

3. The image forming apparatus according to claim 2, wherein the control unit compares red, green, and blue values of a pixel included in the image data from the predetermined reference member to respective red, green, and blue values of the predetermined data, to determine if the pixel included in the image data from the predetermined reference member is usable for calculation of the amount of toner contained in the test toner image.

4. The image forming apparatus according to claim 3, wherein the test toner image includes a plurality of areas arrayed in a direction perpendicular to the rotational direction of the image bearer, and wherein the control unit calculates an amount of toner contained in each of the plurality of areas of the test toner image.

5. The image forming apparatus according to claim 4, wherein the control unit corrects a control parameter of the image forming apparatus to equalize image density in the direction perpendicular to the rotational direction of the image bearer, based on the amount of toner contained in each of the plurality of areas of the test toner image thus calculated.

6. The image forming apparatus according to claim 3, wherein the toner image forming device forms test toner images of yellow, magenta, cyan, and black, and wherein the control unit determines if the pixel included in the image data from the predetermined reference member is usable for calculation of an amount of toner contained in each of the test toner images of yellow, magenta, cyan, and black.

7. The image forming apparatus according to claim 3, wherein when at least one of differences between the red, blue, and green values of the pixel and the respective red, blue, and green values of the predetermined data exceeds a predetermined threshold deviation, the control unit determines the pixel is unusable for calculation of the amount of toner contained in the test toner image.

8. The image forming apparatus according to claim 7, wherein the control unit displays a message to prompt cleaning of at least one of the image reader and the predetermined reference member based on the number of pixels that the control unit determines are unusable for calculation of the amount of toner contained in the test toner image.

* * * * *